US007598930B2

(12) United States Patent
Choi et al.

(10) Patent No.: US 7,598,930 B2
(45) Date of Patent: Oct. 6, 2009

(54) APPARATUS FOR DRIVING PLASMA DISPLAY PANEL

(75) Inventors: Jeong Pil Choi, Suwon-si (KR); Seong Hee Park, Seoul (KR)

(73) Assignee: LG Electronics Inc., Seoul (KR)

( * ) Notice: Subject to any disclaimer, the term of this patent is extended or adjusted under 35 U.S.C. 154(b) by 688 days.

(21) Appl. No.: 10/994,389

(22) Filed: Nov. 23, 2004

(65) Prior Publication Data

US 2005/0110715 A1 May 26, 2005

(30) Foreign Application Priority Data

Nov. 26, 2003 (KR) ..... 10-2003-0084700

(51) Int. Cl.
*G09G 3/28* (2006.01)

(52) U.S. Cl. ..... 345/60; 345/66

(58) Field of Classification Search ..... 345/60–111
See application file for complete search history.

(56) References Cited

U.S. PATENT DOCUMENTS

2003/0030604 A1* 2/2003 Moon et al. ..... 345/87
2003/0043100 A1 3/2003 Moon

FOREIGN PATENT DOCUMENTS

EP 0740285 10/1996
EP 1349140 10/2003
WO WO 99/63513 12/1999
WO WO 00/00954 1/2000

* cited by examiner

*Primary Examiner*—Amare Mengistu
*Assistant Examiner*—Hong Zhou
(74) *Attorney, Agent, or Firm*—KED & Associates LLP

(57) ABSTRACT

Disclosed therein is an apparatus for driving a plasma display panel, with a simple structure. The apparatus includes a signal processor for converting an external image signal into image data suitable for driving the plasma display panel; a data arranger for reconstructing the image data to a plurality of sub-fields in order to process the gray scale of the image data converted by the signal processor and serially transmitting control data corresponding to one or more scan lines; an X-electrode driver for receiving the control data corresponding to one or more scan lines from the data arranger and applying an address pulse corresponding to the control data to X electrodes; a Y-electrode driver for applying a scan pulse for addressing and a sustain pulse for maintaining a discharge to Y electrodes; a Z-electrode driver for applying the sustain pulse for maintaining a discharge to Z electrodes; and a main controller for performing a control operation to sequentially read out the image data reconstructed by the data arranger according to the external image signal and to transmit the control data corresponding to one or more scan lines to the X-electrode driver.

13 Claims, 3 Drawing Sheets

APPARATUS FOR DRIVING PLASMA DISPLAY PANEL

This Nonprovisional application claims priority under 35 U.S.C. § 119(a) on Patent Application No. 10-2003-0084700 filed in Korea on Nov. 26, 2003, the entire contents of which are hereby incorporated by reference.

BACKGROUND OF THE INVENTION

1. Field of the Invention

The present invention relates to an apparatus for driving a plasma display panel, and more particularly to an apparatus for driving a plasma display panel, with a simple structure.

2. Description of the Background Art

FIG. 1 illustrates a general AC (Alternative Current) surface-discharge plasma display panel. The PDP includes front and rear transparent glass substrates 122 and 124 which are 100 to 200 μm away from each other in parallel. Partition walls 126 are formed on the rear substrate 124 through a thick film printing technique at intervals of 400 μm, leaving a space between the front and rear substrates 122 and 124. Each of the partition walls 126 is 50 μm in width.

Column electrodes Xj (where j=1, 2, . . . , m) of X electrodes made of aluminum (Al) or an Al alloy are formed between the partition walls 126 to perform an address function. The column electrodes Xj are parallel to the partition walls 126 and has a thickness of 100 nm. RGB florescent material layers are coated over the respective X electrodes Xj to a thickness of 10 to 30 nm to form light emitting layers 136.

Row electrodes Yi and Zi (where i=1, 2, . . . , n) of Y and Z electrodes perpendicular to the X electrodes are formed on the front substrate 122. The electrodes Yi and Zi are extended in parallel to a thickness of a few hundred nm by the deposition of ITO (Indium tin Oxide) or SnO (tin oxide). The adjacent row electrodes Yi and Zi constitute row-electrode pairs (Yi, Zi).

Metal bus electrodes αi and βi narrower than the row electrodes Yi and Zi are closely formed to the row electrodes Yi and Zi. These bus electrodes αi and βi are auxiliary electrodes for making up for the row electrodes Yi and Zi having weak conductivity.

In order to protect these row electrodes Yi and Zi, a dielectric layer 130 is formed to a thickness of 20 to 30 μm. An MgO layer 132 is coated over the dielectric layer 130 to a thickness of a few hundred nm.

After the electrodes Xj, Yi, Zi, αi and βi, the dielectric layer 130 and the light emitting layers 136 are formed, the front and rear substrates 122 and 124 are sealed up and the gas of a discharge space 128 is ejected. Then, moisture is removed from the surface of the MgO layer 132 by baking. Next, inert mixture gas including 3 to 7 percent NeXe gas is injected into the discharge space 128 by 400 to 600 torr.

A unit light emitting region is defined as one pixel P(i, j) based on an intersection of the row electrodes Yi and Zi and the column electrodes Xj. If a wall voltage is formed by an addressing discharge between the electrodes Xj and Yi, a sustaining pulse is applied between the electrodes Yi and Zi to maintain a discharge. Therefore, the luminescent material layer 136 is excited to emit light. Moreover, a light emitting operation is controlled through selection, sustenance and erasure of a light emitting discharge of the pixel P(i, j) by a voltage applied between the electrodes Xj, Yi and Zi.

FIG. 2 is a block diagram showing a driving apparatus for a general plasma display panel. Referring to FIG. 2, a signal processor 210 converts an external image signal into image data suitable for driving the PDP.

A data arranger 220 reconstructs the image data of one TV field to a plurality of sub-fields in order to process the gray scale of the image data converted by the signal processor 210.

An X-electrode driver 230 and a Y-electrode driver 240 respectively apply to X and Y electrodes address and scan pulses for forming a wall voltage on a discharge cell of the plasma display panel. The Y-electrode driver 240 and a Z-electrode driver 250 alternatively apply to Y and Z electrodes a sustain pulse for maintaining the discharge of a discharge cell on which the wall voltage is formed.

A main controller 260 performs a control operation to sequentially read the image data reconstructed by the data arranger 20 according to the external image signal and to be supplied to the X-electrode driver 230 one scan line by one scan line. Moreover, the main controller 260 supplies a logic control pulse to a high-voltage driving circuit 270.

The high-voltage driving circuit 270 receives the logic control pulse from the main controller 260 and supplies a high-voltage control pulse to the X-electrode, Y-electrode and Z-electrode drivers 230, 240 and 250.

FIG. 3 shows the relationship between the data arranger 220 and the X-electrode driver 230 illustrated in FIG. 2. FIG. 4 shows waveforms for driving data integrated circuits (ICs) of the X-electrode driver 230 illustrated in FIG. 3.

As shown in FIG. 3, the X-electrode driver 230 includes data ICs 310 for respectively processing one-frame image data reconstructed to a plurality of sub-fields by the data arranger 220.

The data ICs 310 receive control data corresponding to one scan line from the main controller 260.

Each of the data ICs 310 has 6 input pins and 96 output pins and receives the control data from the main controller 260 through the 6 input pins. In order to generate 96 outputs from 6 inputs, each of the data ICs 310 necessitates 16 address clocks per scan line.

The data arranger 220 includes a first temporary storage 221, for example, a shift register for sequentially storing control data of one scan line, and a second temporary storage 223, for example, a latch for sending the control data of one scan line stored in the first temporary storage 221 at a predetermined time.

The number of pins of an output terminal of the second temporary storage 223 is closely related to the number of input pins of each of the data ICs 310. That is, an input terminal of each of the data ICs 310 for receiving the control data of one scan line from the second temporary storage 223 at a predetermined time has 6 pins. Moreover, since data is transmitted in parallel to the data ICs 310 from the second temporary storage 223, the number of pins of the output terminals of the second temporary storage 223 is 6 times the number of the data ICs 310.

For example, an XGA (Extended Graphics Array) resolution display size of 1366×768 pixels is 4098 (=1366×3 (RGB)) in the total number of pixels. Since the required number of the data ICs is generally 22, the number of pins of the output terminal of the second temporary storage 223 is 132 (=22×6).

When the control data of one scan line is transmitted in parallel, the number of pins of the output terminal of the second temporary storage 223 becomes large. Furthermore, since the first temporary storage 221 should store all the control data of one scan line, the storage capacity of the first temporary storage 221 should be large enough to store n×6 bits (where n is the number of data ICs). In this case, the 6 bits means the amount of control data transmitted to drive one data IC 310 having 6 input pins.

SUMMARY OF THE INVENTION

Accordingly, the present invention has been made to solve the above problems occurring in the prior art, and it is an object of the present invention to provide a driving apparatus for a plasma display panel, including a temporary storage having a storage capacity less than a conventional one and minimizing the number of pins of an output terminal.

According to an aspect of the present invention, there is provided a driving apparatus of a plasma display panel, including a signal processor, a data arranger, an X-electrode driver, a Y-electrode driver, a Z-electrode driver and a main controller.

The signal processor converts an external image signal into image data suitable for driving the plasma display panel.

A data arranger reconstructs the image data to a plurality of sub-fields in order to process the gray scale of the image data converted by the signal processor and serially transmits control data corresponding to one or more scan lines.

An X-electrode driver serially receives the control data corresponding to one or more scan lines from the data arranger and applies to X electrodes an address pulse corresponding to the control data A Y-electrode driver applies a scan pulse for address and a sustain pulse for maintaining a discharge to Y electrodes.

A Z-electrode driver applies the sustain pulse for maintaining a discharge to Z electrodes.

A main controller performs a control operation to sequentially read out the image data rearranged by the data arranger according to the external image signal and to transmit the control data corresponding to one or more scan lines to the X-electrode driver.

The data arranger according to the present invention minimizes the number of pins of an output terminal of the data arranger and the storage capacity of an integrated temporary storage by serially transmitting the image data to data ICs.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

An apparatus for driving a plasma display panel, includes a signal processor for converting an external image signal into image data suitable for driving the plasma display panel; a data arranger for reconstructing the image data to a plurality of sub-fields in order to process the gray scale of the image data converted by the signal processor and serially transmitting control data corresponding to one or more scan lines; an X-electrode driver for receiving the control data corresponding to one or more scan lines from the data arranger and applying an address pulse corresponding to the control data to X electrodes; a Y-electrode driver for applying to Y electrodes a scan pulse for addressing and a sustain pulse for maintaining a discharge; a Z-electrode driver for applying the sustain pulse for maintaining a discharge to Z electrodes; and a main controller for performing a control operation to sequentially read out the image data reconstructed by the data arranger according to the external image signal and to transmit the control data corresponding to one or more scan lines to the X-electrode driver.

The data arranger includes an integrated temporary storage for temporarily storing the control data corresponding to one or more scan lines, and the X-electrode driver includes a plurality of data integrated circuits for serially receiving the control data corresponding to one or more scan lines stored in the integrated temporary storage.

The integrated temporary storage has a storage capacity larger than a capacity for storing control data corresponding to one or more scan lines.

An output terminal of the data arranger includes a first pin for generating a select signal for selecting one of the plurality of data integrated circuits and a second pin for serially transmitting the image data stored in the integrated temporary storage.

The data arranger and the X-electrode driver use an optical fiber as a transmission medium.

Preferred embodiments of the present invention will be described in more detail with reference to the drawings.

Figure 1:
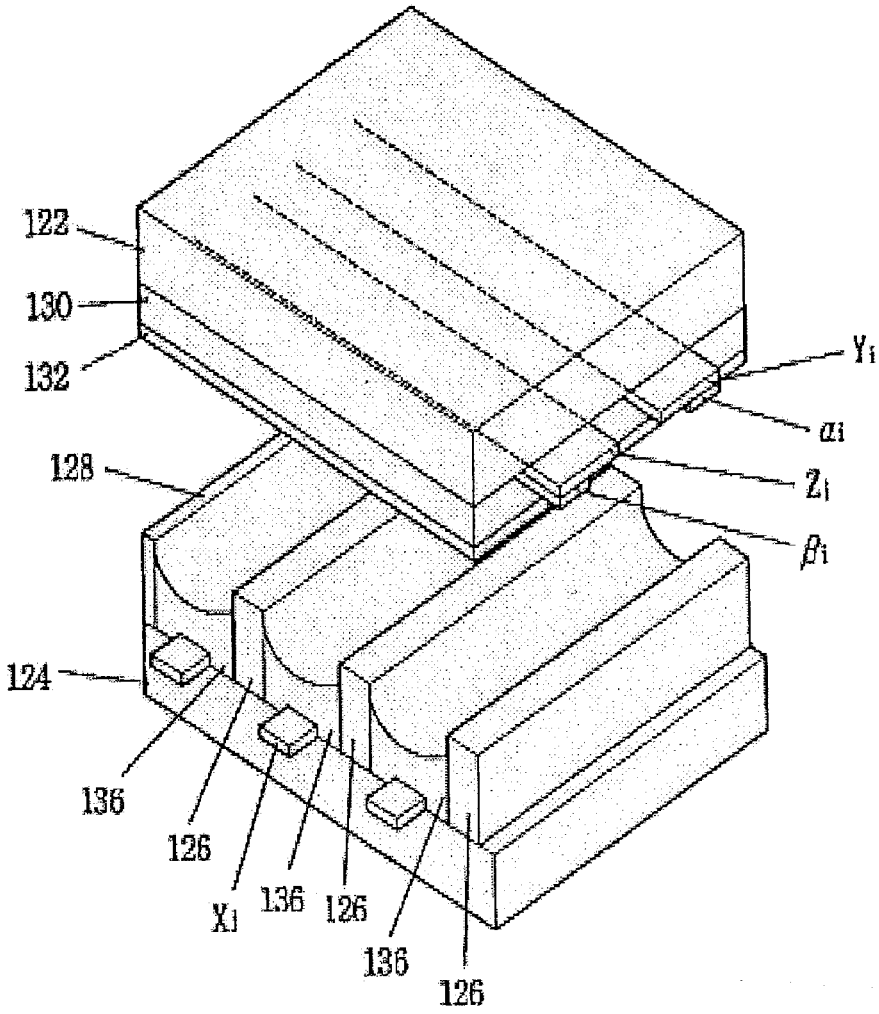
FIG. 1 illustrates the structure of a general AC surface-discharge plasma display panel.
Figure 2:
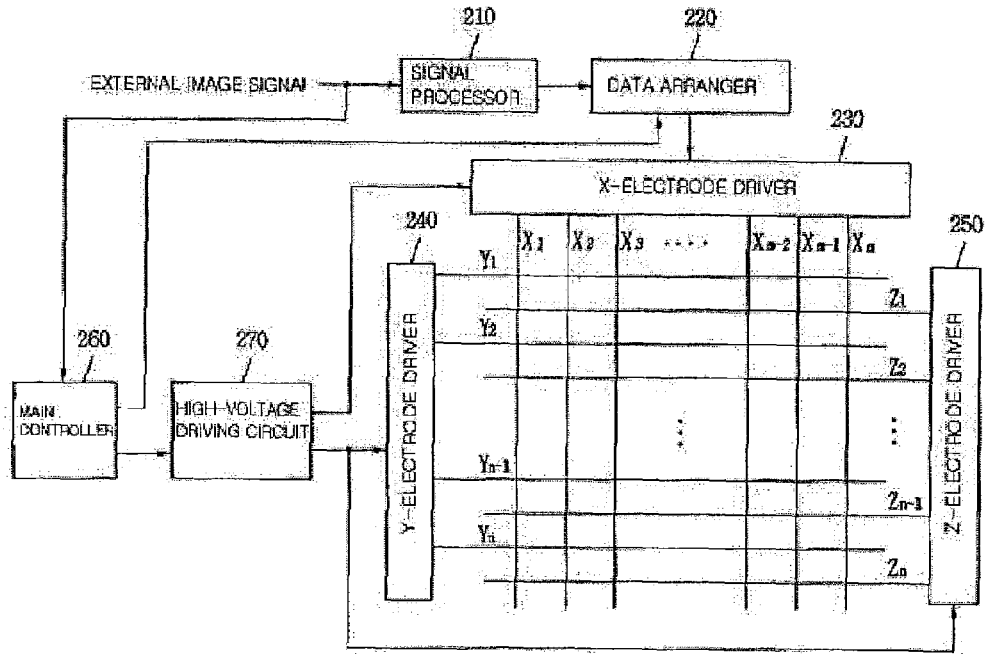
FIG. 2 is a block diagram illustrating a driving apparatus for a general plasma display panel.
Figure 3:
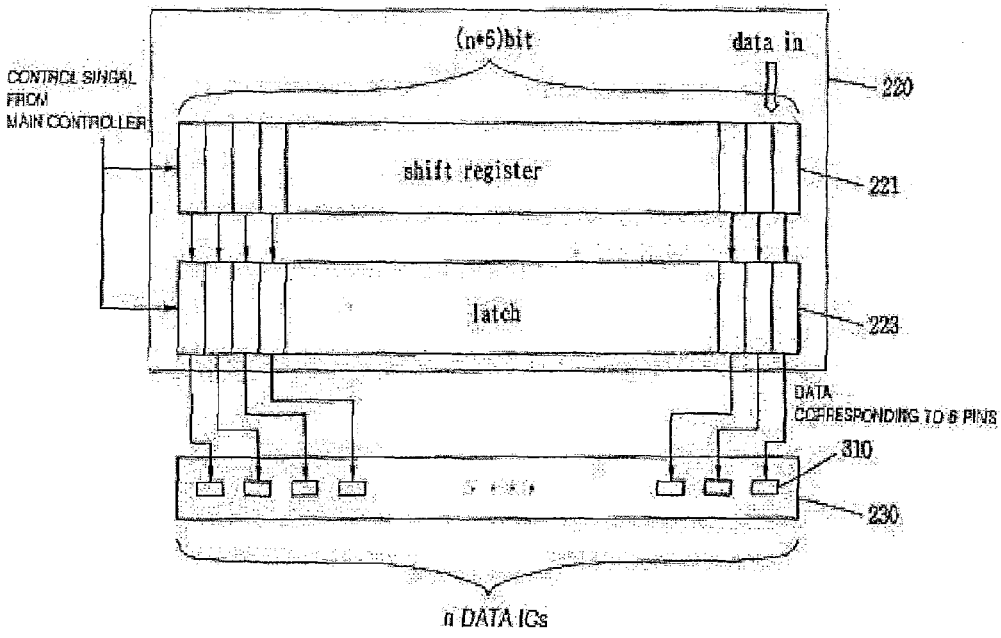
FIG. 3 illustrates the relationship between a data arranger and an X-electrode driver of the driving apparatus of FIG. 2.
Figure 4:
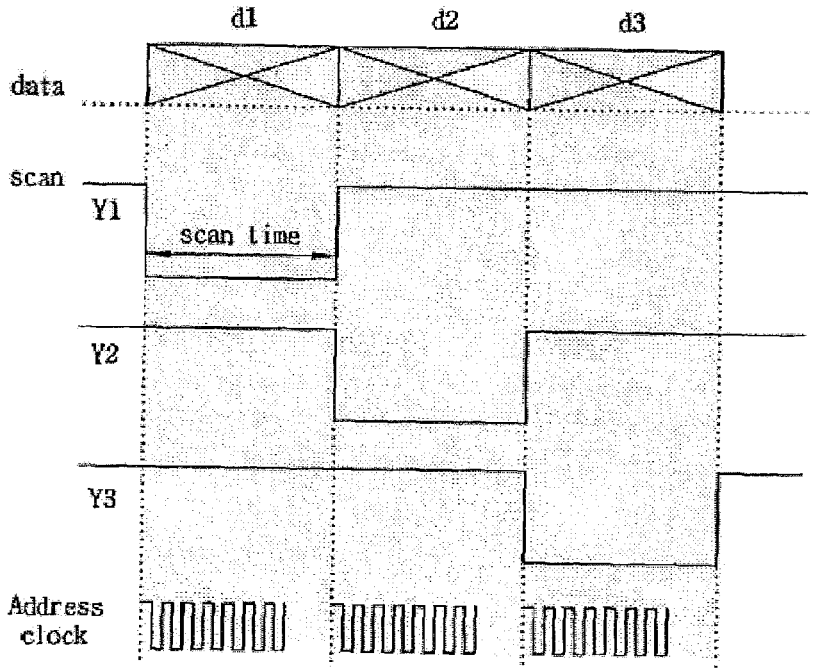
FIG. 4 illustrates waveforms for driving data ICs of the X-electrode driver of FIG. 3.
Figure 5:
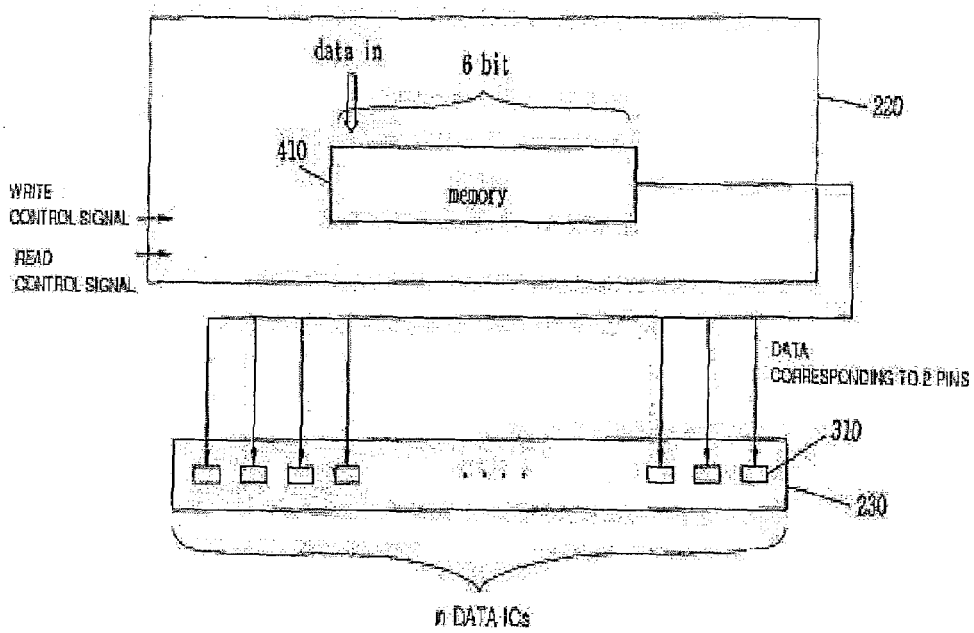
FIG. 5 illustrates the relationship between a data arranger and an X-electrode driver according to the present invention.

FIG. 5 illustrates the relationship between a data arranger and an X-electrode driver. Referring to FIG. 5, a data arranger 220 includes an integrated temporary storage 410 for serially transferring control data corresponding to one or more scan lines to data ICs 310 contained in an X-electrode driver 230.

The integrated temporary storage 410 transmits the control data to the data ICs 310 not in parallel but in series. The control data stored in the integrated temporary storage 410 is control data corresponding to one or more scan lines.

The integrated temporary storage 410 temporarily stores 6-bit control data corresponding to one scan line. Further, the integrated temporary storage 410 serially transmits the control data corresponding to one scan line to a 6-pin input terminal of the data IC 310 according to a write control signal and a read control signal.

The integrated temporary storage 410 may temporarily store control data corresponding to one scan line or control data corresponding to one or more scan lines.

If the integrated temporary storage 410 temporarily stores control data corresponding to two scan lines, the integrated temporary storage 410 serially transmits, by the control of the main controller 260, the first control data to the m-th data IC and the second control data to the (m+1)-th data IC.

The data ICs 310 are divided to (n/2) groups. If the integrated temporary storage 410 temporarily stores control data corresponding to two scan lines, the integrated temporary storage 410 serially transmits the stored first control data to the first data ICs of the groups and the second control data to the second data ICs 310 of the groups.

The integrated temporary storage 410 has a storage capacity corresponding to the amount of two control data.

The conventional temporary storage has a storage capacity for storing control data corresponding to all scan lines. On the other hand, since the integrated temporary storage according to the present invention serially transmits control data corresponding to one or more scan lines to the data ICs 310, the integrated temporary storage 410 needs only a storage capacity sufficient to store control data corresponding to one or more scan lines.

For example, if the integrated temporary storage 410 stores the control data corresponding to one scan line, it needs only a 6-bit storage capacity, and if it stores the control data corresponding to p scan lines, it needs only a (6xp)-bit storage capacity.

The integrate temporary storage 410 has two pins at its output terminal, one for selecting a specific data IC to which image data stored in the integrated temporary storage 410 is to be input, the other for transmitting image data stored in the integrated temporary storage 410 to the data ICs 310.

When the integrated temporary storage 410 serially transmits image data to a plurality of data ICs 310, if an optical fiber is used as a transmission medium for connecting the integrated temporary storage 410 to the data ICs 310, high transmission speed can be obtained and noise can be remarkably reduced.

As described above, since the conventional data arranger 220 transmits in parallel the image data to the data ICs 310, the number of pins of the output terminal of the data arranger 220 and the storage capacity of the first temporary storage 221 become large. According to the present invention, since the data arranger 220 serially transmits the image data to the data ICs 310, the number of pins of the output terminal of the data arranger 220 and the storage capacity of the integrated temporary storage 410 can be minimized.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for driving a plasma display panel, comprising:

a signal processor for converting an external image signal into image data suitable for driving the plasma display panel;

a data arranger for reconstructing the image data to a plurality of sub-fields in order to process the gray scale of the image data converted by the signal processor and serially transmitting control data corresponding to one or more scan lines;

an X-electrode driver for receiving the control data corresponding to one or more scan lines from the data arranger and applying an address pulse corresponding to the control data to X electrodes;

a Y-electrode driver for applying a scan pulse for addressing and a sustain pulse for maintaining a discharge to Y electrodes;

a Z-electrode driver for applying the sustain pulse for maintaining a discharge to Z electrodes;

a main controller for performing a control operation to sequentially read out the image data reconstructed by the data arranger according to the external image signal and to transmit the control data corresponding to one or more scan lines to the X-electrode driver;

wherein the data arranger is coupled between the main controller and X-electrode driver and includes an integrated temporary storage for temporarily storing 6-bit control data corresponding to only one scan line at a time, wherein the integrated temporary storage has a 6-bit storage capacity for storing the 6-bit control data corresponding to only the one scan line, wherein the X-electrode driver includes a plurality of data integrated circuits for serially receiving the 6-bit control data corresponding to one scan line stored in the integrated temporary storage, wherein an output terminal assembly of the integrated temporary storage includes a first pin to output a select signal to select one of the plurality of data integrated circuits, and a second pin to serially transmit the image data stored in the integrated temporary storage, and wherein the first and second pins are directly connected to each of the data integrated circuits.

2. The apparatus as claimed in claim 1, wherein the X-electrode driver includes at least two data integrated circuits, wherein the control data is sequentially input into the at least two data integrated circuits through one line at predetermined delay time intervals, and wherein the control data includes image data stored in the integrated temporary storage and a select signal for selecting one of the at least two data integrated circuits.

3. The apparatus as claimed in claim 1, wherein a line for transmitting the control data into the data integrated circuits is formed from an optical fiber.

4. The apparatus as claimed in claim 1, wherein a capacity for transmitting the control data of the one line is 6 bits.

5. The apparatus as claimed in claim 1, wherein the 6-bit storage capacity of the integrated temporary storage is arranged to include p storage locations with $p \geqq 1$, each storage location having a width of 6 bits to store the 6-bit control data that corresponds to only one scan line at a time.

6. The apparatus as claimed in claim 5, wherein p is equal to 1.

7. The apparatus as claimed in claim 6, wherein the temporary integrated storage only stores 6-bit control data for only one of the data integrated circuits of the X-electrode driver at a time.

8. The apparatus as claimed in claim 6, wherein all the data integrated circuits of the X-electrode driver serially receive corresponding 6-bit control data through the second pin of the temporary integrated storage.

9. The apparatus as claimed in claim 8, wherein the integrated temporary storage is only coupled to the plurality of data integrated circuits in the X-electrode driver through the first pin and the second pin.

10. The apparatus as claimed in claim 9, further comprising:

an optical fiber signal line which sequentially carries the 6-bit control data output from the second pin of the integrated temporary storage to each of the plurality of data integrated circuits of the X-electrode driver.

11. The apparatus as claimed in claim 1, wherein the 6-bit control data includes at least a portion of the image data and the select signal.

12. The apparatus of claim 1, wherein the integrated temporary storage stores the 6-bit control data for only one of the data integrated circuits at any given time.

13. An apparatus for driving a plasma display panel, comprising:

a signal processor for converting an external image signal into image data suitable for driving the plasma display panel;

a data arranger for reconstructing the image data to a plurality of sub-fields in order to process the gray scale of the image data converted by the signal processor and serially transmitting control data corresponding to one or more scan lines;

an X-electrode driver for receiving the control data corresponding to one or more scan lines from the data arranger and applying an address pulse corresponding to the control data to X electrodes;

a Y-electrode driver for applying a scan pulse for addressing and a sustain pulse for maintaining a discharge to Y electrodes;

a Z-electrode driver for applying the sustain pulse for maintaining a discharge to Z electrodes;

a main controller for performing a control operation to sequentially read out the image data reconstructed by the data arranger according to the external image signal and to transmit the control data corresponding to one or more scan lines to the X-electrode driver;

wherein the data arranger is coupled between the main controller and X-electrode driver and includes an integrated temporary storage for temporarily storing 6-bit control data corresponding to only one scan line at a time, wherein the integrated temporary storage has a 6-bit storage capacity for storing the 6-bit control data corresponding to only the one scan line, wherein the X-electrode driver includes a plurality of data integrated circuits for serially receiving the 6-bit control data corresponding to one scan line stored in the integrated temporary storage, wherein an output terminal assembly of the integrated temporary storage includes a first pin to output a select signal to select one of the plurality of data integrated circuits, and a second pin to serially transmit the image data stored in the integrated temporary storage, and wherein the first and second pins are directly connected to each of the data integrated circuits, wherein all the data integrated circuits of the X-electrode driver serially receive corresponding 6-bit control data through the second pin of the temporary integrated storage and wherein the integrated temporary storage is only coupled to the plurality of data integrated circuits in the X-electrode driver through the first pin and the second pin.

* * * * *